United States Patent [19]

Robinson et al.

[11] 4,066,181

[45] Jan. 3, 1978

[54] CONTAINER AND CLOSURE ASSEMBLY

[75] Inventors: William H. Robinson; David O. Allen; Harry A. E. Wombold, all of Wilmington, Ohio

[73] Assignee: Buckeye Molding Company, New Vienna, Ohio

[21] Appl. No.: 667,290

[22] Filed: Mar. 16, 1976

[51] Int. Cl.[2] ..... B65D 41/32

[52] U.S. Cl. ..... 215/256; 215/277; 215/350

[58] Field of Search ..... 215/256, 277, 350

[56] References Cited

U.S. PATENT DOCUMENTS

| | | | |
|---|---|---|---|
| 1,095,470 | 5/1914 | Schloss | 215/277 |
| 2,916,174 | 12/1959 | Orr | 215/277 |
| 3,019,933 | 2/1962 | Gould | 215/277 |
| 3,142,403 | 7/1964 | Fox | 215/256 |
| 3,632,004 | 1/1972 | Grimes | 215/277 |
| 3,860,137 | 1/1975 | Wilson | 215/256 |
| 3,955,716 | 5/1976 | Goncalves | 215/256 |
| 3,974,932 | 8/1976 | Faulstich | 215/256 |

FOREIGN PATENT DOCUMENTS

| | | | |
|---|---|---|---|
| 222,526 | 7/1962 | Austria | 215/256 |
| 669,951 | 10/1964 | Italy | 215/256 |

*Primary Examiner*—Ro E. Hart
*Attorney, Agent, or Firm*—Dybvig & Dybvig

[57] ABSTRACT

A container and closure assembly wherein the container is adapted to be initially closed by a sealing means such as a vacuum disc. The closure has two positions of attachment to a bead encircling the container. In the first position of attachment, which accommodates the aforementioned sealing means, the container bead is engaged in an annular notch located in the inside wall of a closure skirt. The notch weakens the skirt so as to allow a distal end of the skirt to be torn from a remaining portion of the closure to free the remaining portion of the closure from attachment to the container bead. This exposes the sealing means so as to allow a removal thereof and access to the contents of the container. The remaining portion of the closure is then reattachable to the container bead at a second position of attachment rendered accessible by removal of the sealing means for reclosure of the container. In a first embodiment, the closure has retention ribs permitting preassembly of the sealing means to the closure. In a modification, the retention means comprises an inwardly directed skirt bead sized to retain the sealing means.

13 Claims, 7 Drawing Figures

FIG-1
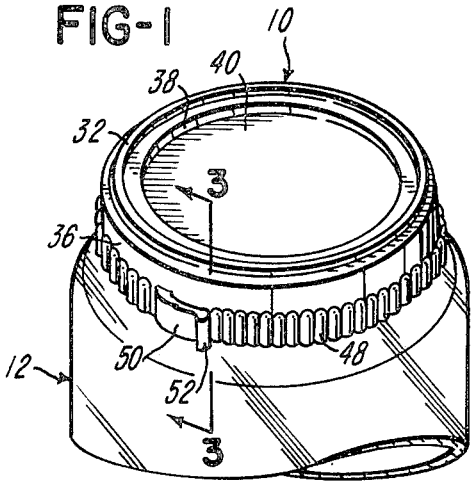
FIG-2
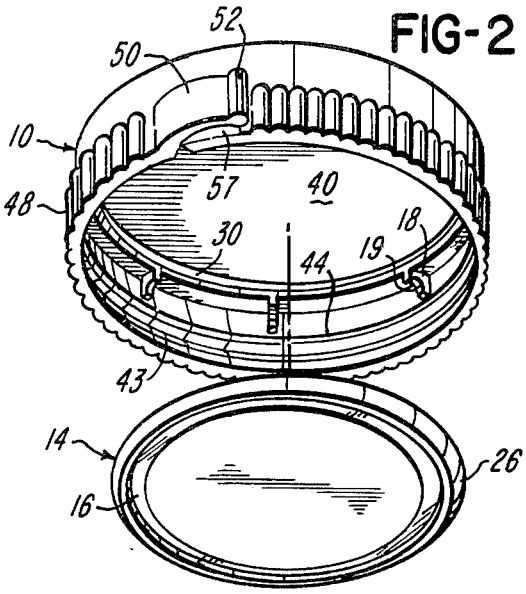
FIG-5
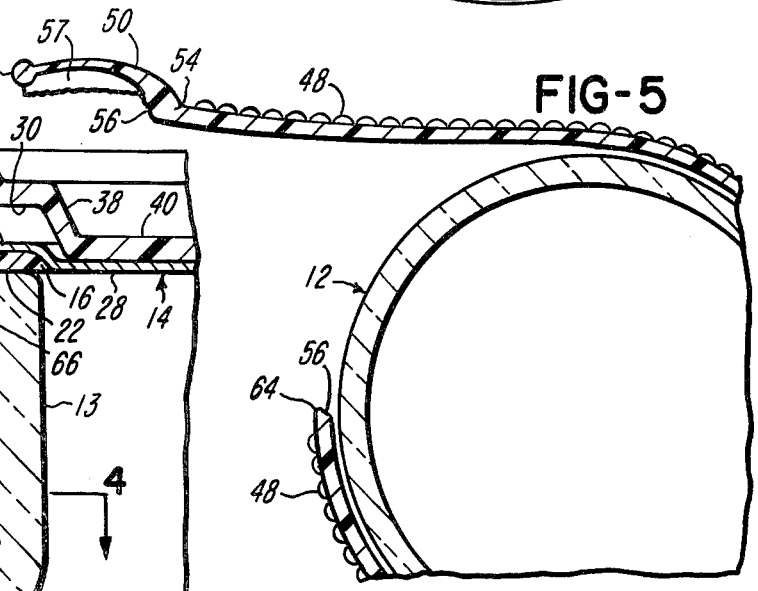
FIG-3
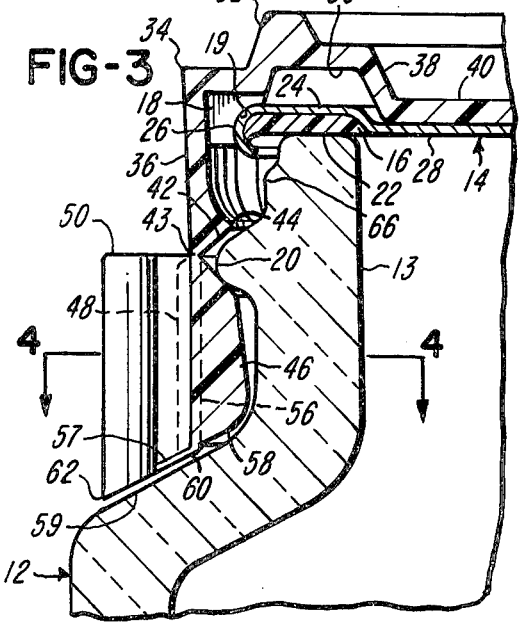
FIG-6
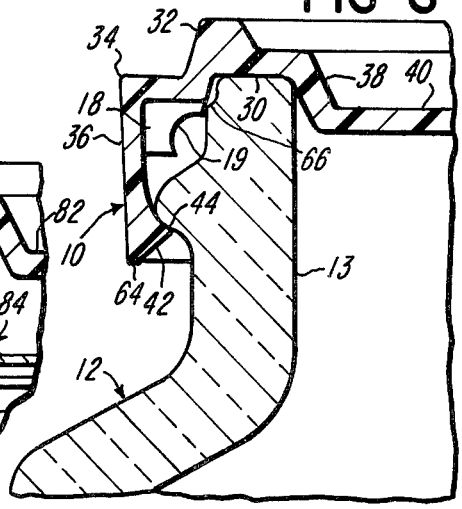
FIG-4
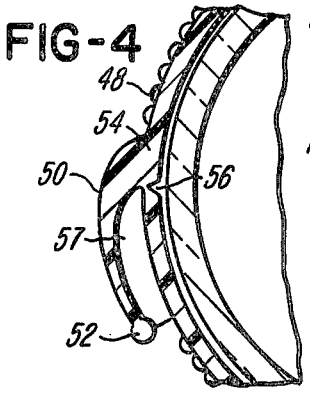
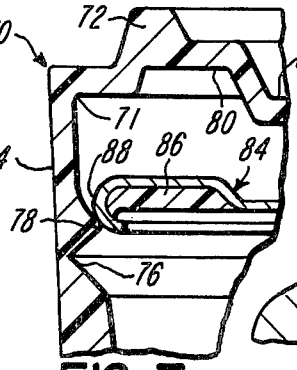
FIG-7

CONTAINER AND CLOSURE ASSEMBLY

BACKGROUND OF THE INVENTION

The present invention relates to closures for containers, such as containers for foodstuffs, and more particularly to protective closures capable of protecting a preexisting seal, such as a vacuum or hermetic seal, and after removal of such seal, capable of reclosing the container so as to continue to protect the contents thereof.

Various types of containers having protective seals, such as vacuum and hermetic seals, are known in the art. It is also known in the art to employ protective covers for such sealed containers which minimize the possibilities of tampering with or inadvertent damage to the protective seal. It is also known in the prior art to utilize reclosable protective covers which can first be removed to allow access to the sealing means for removal thereof and then can be used to reclose the container so as to continue to protect unused contents of the container. A typical prior art closure of the type under discussion comprises a metallic cover having helical threads which allow the cover to be applied initially to a container sealed by a vacuum disc and, after removal of the vacuum disc, reapplied to the container to protect its contents. The present invention seeks to minimize the costs of such reusable closures.

It is accordingly an object of the present invention to provide a reusable closure for sealed containers.

Another object of the present invention is to provide a reusable closure which is of molded plastic construction.

Still another object of the present invention is the provision of a reusable closure having a first position of attachment to the container which accommodates a sealing means, such as a vacuum disc, and which has a tear strip which disables or releases the first position of attachment but which, upon removal of the sealing means, has a second position of attachment to the container for reclosing the container.

SUMMARY OF THE INVENTION

In the present invention, the need for helical threads and the like on a closure is avoided through the use of a pliant thermoplastic material to form the closure and through the use of a skirt depending from the closure which has an internally disposed, annular notch capable of being engaged to a suitably formed bead on the container by pressing the closure onto a neck of the container in a fashion which expands a portion of the closure skirt over the container bead and which results in a first position of attachment between the closure and the container. The portion of the closure skirt expanded over the container bead includes one or more suitably located weakened portions or score lines and associated finger-engaging means or handle means which allow the lower portion of the closure skirt to be torn away from a remaining portion of the closure so as to disable the first attaching means and release the remaining portion of the closure for easy removal from the container. Such removal exposes the sealing means, which has heretofore protected the contents of the container, and allows removal of the sealing means in conventional fashion, as by a pry device. Upon removal of the sealing means, which may be a vacuum disc, the edge or lip of the container to which the sealing means was mounted is exposed and the remaining portion of the closure from which the tear strip has been removed is equipped with means engageable with the exposed lip of the container and bead means engageable with the container bead for reclosing the container. In one embodiment, the closure includes internally disposed means for retaining a vacuum disc or other sealing means in position for a convenient initial assembly to the container. In another embodiment, the closure is sized to retain a vacuum disc or other sealing means by an interference fit with a reclosure bead, this second embodiment again allowing a convenient assembly of the vacuum disc or other sealing means to the container.

BRIEF DESCRIPTION OF THE DRAWINGS

In the drawings:

FIG. 1 is a fragmentary perspective view of a closure and container in accordance with the present invention.

FIG. 2 is an exploded perspective view illustrating the closure of the present invention with a vacuum disc exploded therefrom.

FIG. 3 is a fragmentary section view taken substantially along the line 3—3 of FIG. 1.

FIG. 4 is a fragmentary section view taken substantially along the line 4—4 of FIG. 3.

FIG. 5 is a section view analogous to FIG. 4 illustrating the removal of a tear strip from the closure.

FIG. 6 is a section view analogous to FIG. 3 illustrating the reclosure of the container after removal of the vacuum disc.

FIG. 7 is a fragmentary section view illustrating a modification.

DESCRIPTION OF THE PREFERRED EMBODIMENT

FIG. 1 of the drawings illustrates the closure 10 of the present invention after the same has been applied in a first position to a container 12 and the assembled container and closure are in readiness for delivery to a customer or ultimate user.

The closure 10 is preferably a molded thermoplastic body having a recessed, centrally located panel portion 40 surrounded by an upward step portion 38 which creates an annular channel 30 in the underside of the top of the closure. Lying above the channel 30 is a stacking rib 32, which allows plural closures to be stacked one on top of the other for purposes of storage and shipment. The stacking rib 32 also provides reinforcement above the channel portion 30. The closure 10 is surrounded by a corner portion 34 from which depends a closure skirt 36.

As shown in FIG. 2, the closure 10 is adapted to retain therein a sealing means, such as a vacuum disc 14, having a conventional sealing gasket 16. As a means for retention of the vacuum disc, the closure 10 has formed between the interior walls of the corner portion 34 peripherally spaced ribs 18, which have interior surfaces 19 curved concavely to match the convex curvature of the periphery of the disc 14 and which are thus adapted collectively to receive the disc 14 with a snap fit. The disc 14 may be thus preassembled to the closure 10 for purposes of shipment and ultimate assembly to the container 12.

The container 12 has been sectioned in FIG. 3 to illustrate that the container is glass. It is to be understood, however, that, depending upon the desired use for the container and closure, the container may be metal, plastic, earthenware, ceramic, or the like. The container has the shape of a bottle having an annular wall defining a relatively narrow neck 13 having a single radially outwardly projecting bead 20, which, as will be further described, is used for retention of the closure 10 on the neck 13. The bead 20 is spaced axially from the upper edge 22 of the neck 13.

As can be seen in FIG. 3, the aforementioned vacuum disc 14 is so sized that its gasket 16 can rest upon the edge 22. The gasket 16 is received within an annular channel 24 formed near the outer radius of the vacuum disc 14. The extreme periphery of the disc 14 is formed by a wall 26, which curves downwardly from the base of the channel 24 to extend re-entrantly under the outer periphery of the gasket 16. As shown, the disc 14 may have its central portion closed by a generally flat wall portion 28.

Referring to the closure skirt 36, the skirt can be seen to have molded therein an annular, V-shaped notch 42 which extends circumferentially along the internal wall of the skirt. The formation of the notch 42 produces a weakened wall 43 at the apex of the notch 42. The upper sidewall of the notch 42, as appears in FIG. 3, can be seen to extend inwardly to form with the interior sidewall of the closure an inwardly directed bead 44.

Below the aforementioned notch 42, the skirt has a thickened extension or tear strip 46. The exterior wall of the extension 46 is knurled, so to speak, by means of a plurality of axially extending and closely spaced ribs 48. The ribs 48 entirely surround the outer wall of the extension 46 except for a gap in which is located a handle 50 terminating at one end with a thickened ridge 52 and anchored at the opposite end to the extension 46 by means of a thickened footing 54 molded integrally with the closure 10. As shown in FIG. 4, the extension 46 has an axially disposed weakening score line or notch 56 disposed internally adjacent the footing 54.

The handle 50, before the use thereof, is anchored against inadvertent operation by means of a web 57 permitted to form as a flash at the time the closure 10 is molded, as by injection molding.

As best appears in FIG. 3, the distal edge of the extension 46, i.e., the portion of the extension 46 most removed axially from the top of the closure 10, comprises a margin 58, the shape of which generally conforms to the shape of a shoulder 59 formed on the container 12 below the neck 13. Likewise, the handle 50 has a lower margin 60 closely approaching and conforming to the shoulder 59, and the ridge 52 has a lower margin 62, which also closely approaches and conforms to the shape of the shoulder 59.

The extension 46 being relatively thick at the distal end of the skirt and having been shaped at its margin 58 to closely approach and conform to the shape of the shoulder 59 minimizes the chances for an inadvertent or unauthorized entry to the contents of the container 12. Thus, until the handle 50 has been operated to cause the skirt to tear along the weakening line 56, it is not likely that a curious shopper can gain access to the contents of the container 12. In particular, the thickness of the extension 46 reduces the likelihood that one can force entry to the container contents by using fingernails or the like in an effort to pry the closure 10 from the container.

In describing the operation of the closure 10, it can be assumed that the vacuum disc 14 has been snapped into the retaining ribs 18 and that the closure 10 has been pressed to a first position upon the container 12 so as to cause the container bead 20 to enter the closure notch 42, which functions as a first closure attaching means. It can further be assumed that, by means well known in the art, such as heating followed by cooling or evacuating, a partial vacuum has been established within the container 12, whereby the vacuum disc 14 is pressed securely against the edge 22 of the container by the atmospheric pressure. It can further be assumed, of course, that the container 12 has been partially filled with whatever contents, such as foodstuffs, are to be stored in the container 12 and that the container has been placed in the custody of an ultimate user.

The ultimate user gains access to the contents of the container 12 by manually gripping the handle 50 and pulling the handle with a force sufficient to break the web 57 and to tear the extension 46 axially along the notch 56.

The ultimate user thereafter pulls the handle 50 outwardly from the container 12 in the manner illustrated in FIG. 5 with a sufficient force to tear the extension or tear strip 46 from the balance of the skirt 36 along the weakened wall 43 at the apex of the notch 42 in the skirt, thus removing the extension 46 from the closure 10.

After removal of the extension 46, the closure 10 is removable from the container 12 by the exertion of an upward pull sufficient to cause the ribs 18 to yield and thereby release the vacuum disc 14 from the closure 10. Such separation exposes the vacuum disc 14 so that the disc can be pried off in the usual manner, either by finger manipulation or by use of any desired manual assist, such as is typically available on a manually operated can opener or bottle opener.

After removal of the vacuum disc 14, access has been gained to the contents of the container 12. As frequently is the case, the contents may be only partially removed from the container; and, accordingly, it is desired to reseal the container.

FIG. 6 illustrates utilization of the remaining upper portion of the closure 10 for resealing the container in a second position after the vacuum disc 14 has been removed and discarded. At the time of the reclosure illustrated in FIG. 6, of course, the extension 46 has been removed from the remainder of the skirt 36, only a remnant edge 64 remaining, and the vacuum disc 14 has been removed and discarded, thus exposing the channel 30 located in the inside surface of the closure 10. The removal of the vacuum disc 14 thus allows the upper edge 22 of the container 12 to enter the channel 30 and seat against the base of such channel, as shown in FIG. 6. For such seating to be accomplished, of course, it is necessary that the closure bead 44, which now serves as a second attaching means, pass the container bead 20 with a consequent expansion in the diameter of the closure bead 44 and, after passage of the bead 20, a consequent contraction of the bead 44, which seizes upon the lower margin of the bead 20, such seizure assuring that the base of the channel 30 in the closure will press securely against the edge 22 of the container.

Quite evidently, the remaining portion of the closure 10 illustrated in FIG. 6 can be used an indefinite number of times for openings and closings of the container.

The container 12 illustrated in the drawings can be seen to have an offset ridge 66, the consequence of which is to increase the diameter of the neck of the container between the edge 22 and the bead 20; and it will be noted that absent the reduced diameter of the container neck at the mouth of the container, the closure 10 would not seat firmly upon the edge 22. This construction is, of course, the preference of the container manufacturer. Had the offset 66 not been a feature already present in the container 12, it would, of course, involve only a matter of an adjustment in the dimensions of the closure mold to accommodate whatever configuration the container has at its mouth.

FIG. 7 illustrates a modification of the present invention in which a simplified closure construction is employed. The closure 70 is constructed identically to the closure 10 described above, with the single exception that the ribs 18 in the previously described embodiment have been eliminated, and thus the closure 70 has an unobstructed internal corner 71.

The closure 70 thus has a stacking rib 72 analogous to the previously described stacking rib 32 and a depending skirt 74 similar to the previously described skirt 36. The skirt 74 has an annular, V-shaped notch 76 analogous to the previously described notch 42, which allows the skirt to be torn along the notch 76 in the fashion described previously in reference to the notch 42.

The closure 70 also includes an internally directed rib 78 disposed above the notch 76, which will be used for reclosure of a container, such as the previously described container 12, after a user has initially gained access to the contents of the container in the fashion previously described.

For use during reclosure, the closure 70 has an internally located annular channel 80 appropriately sized for engagement with the edge of a container, such as the container 12. The closure 70 also has a recessed panel 82 supported adjacent the annular channel 80 in the same fashion as described with reference to the closure 10.

The present modification utilizes a vacuum disc 84 supporting an annular gasket 86 in the same fashion as was true of the vacuum disc 14. For the purposes of the present modification, however, it is preferred that the vacuum disc 84 be larger, relative to the closure 70, than was the case with the vacuum disc 14, relative to the closure 10, so that the outer wall 88 of the vacuum disc 84 is capable of being retained within the closure 70 by reason of interference with the inwardly directed bead 78 of the closure 70. Thus, in the present modification, and by reason of the sizing of the vacuum disc 84 relative to the closure 70, the interference fit between the closure bead 78 and the wall 88 of the vacuum disc performs a function similar to that performed by the ribs 18 described in reference to the closure 10.

In the operation of this modification, the closure 70 is pressed upon a container, such as the container 12, until such time as the notch 76 engages an outwardly projecting container bead, such as the bead 20 illustrated in FIG. 3. Thereafter, by heating followed by cooling or by other evacuation means, the pressure of the ambient atmosphere is utilized to effect a pressure seal between the gasket 86 and the upper edge of the container, such as the edge 22 illustrated in FIG. 3. The assembled closure and container (the latter not shown) is then is readiness for distribution to the ultimate user, who can then tear off the lower portion of the skirt 74 in the same fashion as was described in reference to the closure 10. After the lower portion of the skirt 74 has been torn from the skirt at the notch 76, it is then possible, by the exertion of an upward force on the closure 70 sufficient to cause the bead 78 to expand about the wall 88 of the vacuum disc 84, to remove the closure 70 and thereafter, by application of a suitable pry or manual force, to remove the vacuum disc 84. Upon removal of the vacuum disc 84, the container, not shown in FIG. 7, can be reclosed by pressing the remaining portions of the closure 70 onto the container so as to cause the bead 78 to seize about a container bead in the same fashion as previously described in relation to the preferred embodiment and as illustrated in FIG. 6 of the drawings.

Although the preferred embodiments of the present invention have been described, it will be understood that various changes may be made within the scope of the appended claims.

Having thus described our invention, we claim:

1. In a closure for a container having a neck surrounding an opening initially sealed by a sealing means engaged to said neck, said neck having outwardly projecting annular bead means for retaining said closure: panel means for covering said opening and initially covering also said sealing means, and skirt means depending from said panel means for surrounding said neck, said skirt means having first attaching means engaging said bead means for attaching said closure to said container, said first attaching means including a tear strip severable from a remaining portion of said skirt means to disable said first attaching means and thereby permit removal of said remaining portion of said skirt means from said container and said sealing means and removal of said sealing means from said neck, said remaining portion of said skirt means having second attaching means engaging a lower margin of said bead means for attaching said closure to said container after said tear strip has been removed from said skirt means and said sealing means has been removed from said neck.

2. The closure of claim 1 wherein said panel means has an annular channel confronting said sealing means when said panel means initially covers said sealing means, said channel receiving a portion of said neck when said second attaching means engages said bead means.

3. The closure of claim 2 wherein said channel has a base that is pressed against the edge of said neck when said second attaching means engages said bead means.

4. The closure of claim 1 wherein said first attaching means comprises a notch extending annularly along the inside wall of said skirt means, said tear strip comprising a portion of said skirt means adjacent said notch.

5. The closure of claim 4 wherein said second attaching means comprises annular bead means projecting inwardly from the interior wall of said skirt adjacent said notch.

6. The closure of claim 1 including a handle integrally attached to said tear strip and further including means weakening said tear strip adjacent said handle.

7. The closure of claim 1 including rib means disposed at a corner between said skirt and said panel means and projecting inwardly of said closure for releasably seizing said sealing means, said rib means yielding to release said sealing means when said closure is removed from said container.

8. In a closure for a container having a neck surrounding an opening initially sealed by a vacuum disc and having a shoulder surrounding said neck in spaced relation to said opening, said neck having outwardly projecting bead means disposed intermediate said opening and said shoulder for retaining said closure; panel means for covering said opening and initially covering also said vacuum disc, and skirt means depending from said panel means for surrounding said neck, said skirt means having first attaching means engaging said bead means for attaching said closure to said container, said first attaching means including a tear strip severable from the remaining portion of said skirt means to disable said first attaching means and thereby permit removal of said closure from said container and said vacuum disc and removal of said vacuum disc from said neck, said tear strip having a margin closely adjacent said shoulder and generally conforming to the shape of said shoulder, said remaining portion of said skirt means having second attaching means engaging a lower margin of said bead means for attaching said closure to said container after said tear strip has been removed from said skirt means and said vacuum disc has been removed from said neck.

9. The closure of claim 8 including means extending between said margin and said first attaching means for weakening said tear strip, and handle means having a footing integral with said tear strip adjacent said weakening means, said handle means having a margin closely adjacent said shoulder and conforming to the shape of said shoulder.

10. The closure of claim 9 further including tearable web means joining said handle means to said tear strip.

11. A container and closure assembly comprising:

a container having an opening surrounded by an edge, sealing means covering said opening and sealingly engaging said edge, a closure having a first position of engagement with said container for protecting said sealing means, said container having annular bead means spaced from said edge, said closure having a panel portion covering said sealing means and an annular skirt depending from said panel portion and surrounding said container adjacent said opening, said skirt having an annular weakening notch in the interior wall thereof receiving said annular bead means in said first portion, said container having a shoulder spaced from said annular bead means and said skirt having a distal portion adjacent said shoulder, said skirt having finger-engageable means on said distal portion whereby an operator may engage said finger-engageable means and tear said distal portion from the remainder of said skirt at said notch to permit removal of said panel portion and the remainder of said skirt from said container so as to expose said sealing means for removal thereof, said panel portion having an annular channel therein for receiving the edge of said container in a second position of container closure after removal of said sealing means, the remainder of said skirt having an inwardly directed bead adapted to engage a lower margin of said bead means for attaching said closure to said container in said second position.

12. The assembly of claim 11 wherein said annular channel has a base that is pressed against said edge of said container opening in said second position.

13. The assembly of claim 11 including rib means disposed at a corner of said closure between said skirt and said panel portion and projecting inwardly of said closure for releasably seizing said sealing means, said rib means yielding to release said sealing means when said closure is removed from said container.

* * * * *

UNITED STATES PATENT OFFICE

CERTIFICATE OF CORRECTION

PATENT NO. : 4,066,181

DATED : January 3, 1978

INVENTOR(S) : William H. Robinson et al

It is certified that error appears in the above-identified patent and that said Letters Patent are hereby corrected as shown below:

Col. 8, line 3, "porition" should be ---position---.

Signed and Sealed this

Sixth Day of June 1978

[SEAL]

*Attest:*

RUTH C. MASON
*Attesting Officer*

DONALD W. BANNER
*Commissioner of Patents and Trademarks*